US006217038B1

(12) United States Patent
Moe

(10) Patent No.: US 6,217,038 B1
(45) Date of Patent: Apr. 17, 2001

(54) INTEGRAL WHEEL SUPPORT AND BRAKE FOR IN-LINE SKATE

(76) Inventor: Louis C. B. Moe, 12172 Loya River Ave., Fountain Valley, CA (US) 92708

( * ) Notice: Subject to any disclaimer, the term of this patent is extended or adjusted under 35 U.S.C. 154(b) by 0 days.

(21) Appl. No.: 09/205,779

(22) Filed: Dec. 4, 1998

(51) Int. Cl.[7] ..... A63C 17/14
(52) U.S. Cl. ..... 280/11.2; 188/29; 188/68
(58) Field of Search ..... 280/11.2, 11.22, 280/11.28; 188/29, 5, 68; 301/5.3, 5.7, 5.1, 1

(56) References Cited

U.S. PATENT DOCUMENTS

| | | | | |
|---|---|---|---|---|
| 331,470 | * | 12/1885 | Bosworth | 280/11.2 |
| 982,846 | * | 1/1911 | Nesbitt, Sr. | 280/11.2 |
| 1,989,338 | * | 1/1935 | Ruske | 280/11.2 |
| 5,207,438 | * | 5/1993 | Landers | 280/11.2 |
| 5,351,974 | * | 10/1994 | Cech | 280/11.2 |
| 5,511,803 | * | 4/1996 | Kuklos | 280/11.2 |
| 5,791,663 | * | 8/1998 | Klukos | 280/11.2 |
| 6,012,727 | * | 1/2000 | Chang | 280/11.2 |

FOREIGN PATENT DOCUMENTS

WO93/16773 * 9/1993 (WO) ..... 280/11.2

* cited by examiner

*Primary Examiner*—Brian L. Johnson
*Assistant Examiner*—Gerald Klebe
(74) *Attorney, Agent, or Firm*—Roy A. Ekstrand

(57) ABSTRACT

An in-line skate includes a boot and frame secured to the underside thereof. The frame supports a plurality of rolling wheels in an in-line arrangement. A brake assembly operative upon the rearmost wheel in the in-line skate arrangement includes a wheel having a tire coupled to a rim which in turn is coupled to a bearing. The bearing includes an inner race which receives a channel spacer having a channel formed therein. A first hub securable to the frame is slidably supported within the spacer and a spring is captivated between the hub and the inner race of the bearing to bias the hub upwardly with respect to the remainder of the wheel. A second hub is coupled to the slidable first hub and an attachment is provided to secure the first and second hubs to the frame. As a result, the first and second hubs are secured to the skate frame while the spring and channel spacer allow the wheel to move with respect to the skate frame in response to changes in applied weight.

11 Claims, 3 Drawing Sheets

INTEGRAL WHEEL SUPPORT AND BRAKE FOR IN-LINE SKATE

FIELD OF THE INVENTION

This invention relates generally to in-line roller skates and particularly to braking apparatus used therein.

BACKGROUND OF THE INVENTION

In-line skates have experienced a nearly phenomenal growth and increase in popularity in recent years. Such in-line skates differ from conventional roller skates in that the rolling wheels, usually four, are supported in a straight line front to back arrangement rather than the "four corner" arrangement of a conventional roller skate. This in-line wheel arrangement provides a skating characteristic which is, in many respects, a cross between ice-skating characteristics and conventional roller skating characteristics. The in-line arrangement of rolling wheels also provides substantial speed, control, maneuverability and ease of movement. Skilled users are able to enjoy long graceful gliding maneuvers similar to those enjoyed by ice skaters as well as high speed racing and maneuvering. A substantially greater agility is provided by in-line skates over conventional roller skates. The agility and similarity to ice-skating characteristics has resulted in a new sport in which the game of ice hockey is played with minor rule changes on in-line skates.

Historically, as the popularity and interest in in-line skates grew, practitioners in the art endeavored to provide ever improved and evermore appealing in-line skates. There resulted the application of substantial sophistication and technology to provide bearings and wheels which further increased the speed, control, and maneuverability potential of in-line skates. As a result, most commercially available in-line skates are capable of speeds which are often well beyond the skating capabilities and skills of the average user. One particular problem which has arisen is the problem of stopping on in-line skates. Unlike ice skates which allow the skater to stop in a variety of braking actions, in-line skates do not inherently lend themselves to good controlled stopping action.

Confronted with the problem of stopping on in-line skates, practitioners in the art initially employed braking apparatus similar to that utilized on four wheel skates of the type generally referred to as "toe stops" and a further similar variant often referred to as "heel stops". Toe stops provide a high friction material such as rubber or the like supported ahead of the skate toe which is dragged upon the skating surface to achieve braking action. Correspondingly, heel stops utilize a similar high friction material apparatus supported at the rear portion of the skate which is also applied to the skating surface to achieve a frictional stopping action.

While such toe stops and heel stops provided some braking action, they have for the most part proven inadequate due to reduced control and maneuverability. As practitioners in the art continued the development of braking apparatus on in-line skates, apparatus for providing a braking action by displacing one of the skate wheels with respect to the remaining wheels upwardly against a braking surface was provided. U.S. Pat. No. 5,501,474 sets forth a BRAKING DEVICE FOR IN-LINE SKATES having a skate frame supporting an in-line plurality of wheels and a body pivotally mounted to the frame between two of the wheels. Biasing means are provided for resiliently biasing the body toward a cruising configuration relative to the frame and braking means are provided for frictionally interacting with two of the wheels in a tilted braking configuration relative to the frame.

U.S. Pat. No. 5,478,094 sets forth a VARIABLE BRAKING SYSTEM having an in-line skate providing a plurality of wheels supported in an in-line arrangement by a frame. A swing arm is pivotally secured to the frame and supports the rearmost wheel while a spring biases the pivoting arm toward an in-line arrangement. A braking surface is supported above the pivotally supported wheel such that the user is able to tilt the skate and overcome the spring bias to drive the rearmost wheel upwardly against the braking surface.

U.S. Pat. No. 5,486,011 sets forth a SPRING BIASED BRAKING DEVICE FOR IN-LINE ROLLER SKATES having a plurality of wheels supported by a frame in an in-line arrangement. The frame supports an axle carried by a pivoting arm which is spring-biased to a cruising position and which is pivotable upwardly to force the pivotally supported wheel against a brake surface on the underside of the skate boot.

U.S. Pat. No. 5,397,138 sets forth a BRAKING MECHANISM FOR IN-LINE SKATE having a boot together with an elongated base plate secured thereto. A plurality of wheel assemblies are attached in-line to the base plate underside and a braking assembly is further supported by the frame.

While the foregoing described prior art devices have provided improvement in many instances over the basic toe stop and heel stop braking apparatus, they tend to be unduly complex and therefore unduly costly for practical mass production use. Further, many of the devices set forth above result in compromise of the high speed characteristic or potential of in-line skates. As a result, there remains a continuing unresolved need in the art for an improved, more reliable, less complex and lower cost braking apparatus for in-line skates.

SUMMARY OF THE INVENTION

Accordingly, it is a general object of the present invention to provide an improved braking device for in-line skates. It is a more particular object of the present invention to provide a reliable, low cost, relatively simple and integral wheel-operative braking apparatus which safely provides a braking action which relatively unskilled skaters can utilize without compromising the high speed, maneuverability and control characteristics of the in-line skate.

In accordance with the present invention, there is provided for use in combination with an in-line skate having a skate frame and a plurality of wheels secured thereto, an integral wheel support and brake comprising: a wheel having a wheel bearing; a channel spacer coupled to the wheel bearing defining a vertical channel; a wheel support constructed to be attached to the skate frame and slidably received within the vertical channel; spring means applying a bias force to urge the wheel downwardly with respect to the wheel support; and a brake surface above the wheel.

The present invention also provides for use in combination with an in-line skate having a skate frame and a plurality of wheels secured thereto, an integral wheel support and brake comprising: a brake shoe having a brake surface; a wheel having a wheel bearing; a sliding support, coupled to the bearing, supporting the wheel upon the skate frame such that the wheel is movable between a first position against the brake surface and a second position spaced from the brake surface; and spring means coupled between the sliding support and the wheel bearing for urging the sliding support toward the second position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
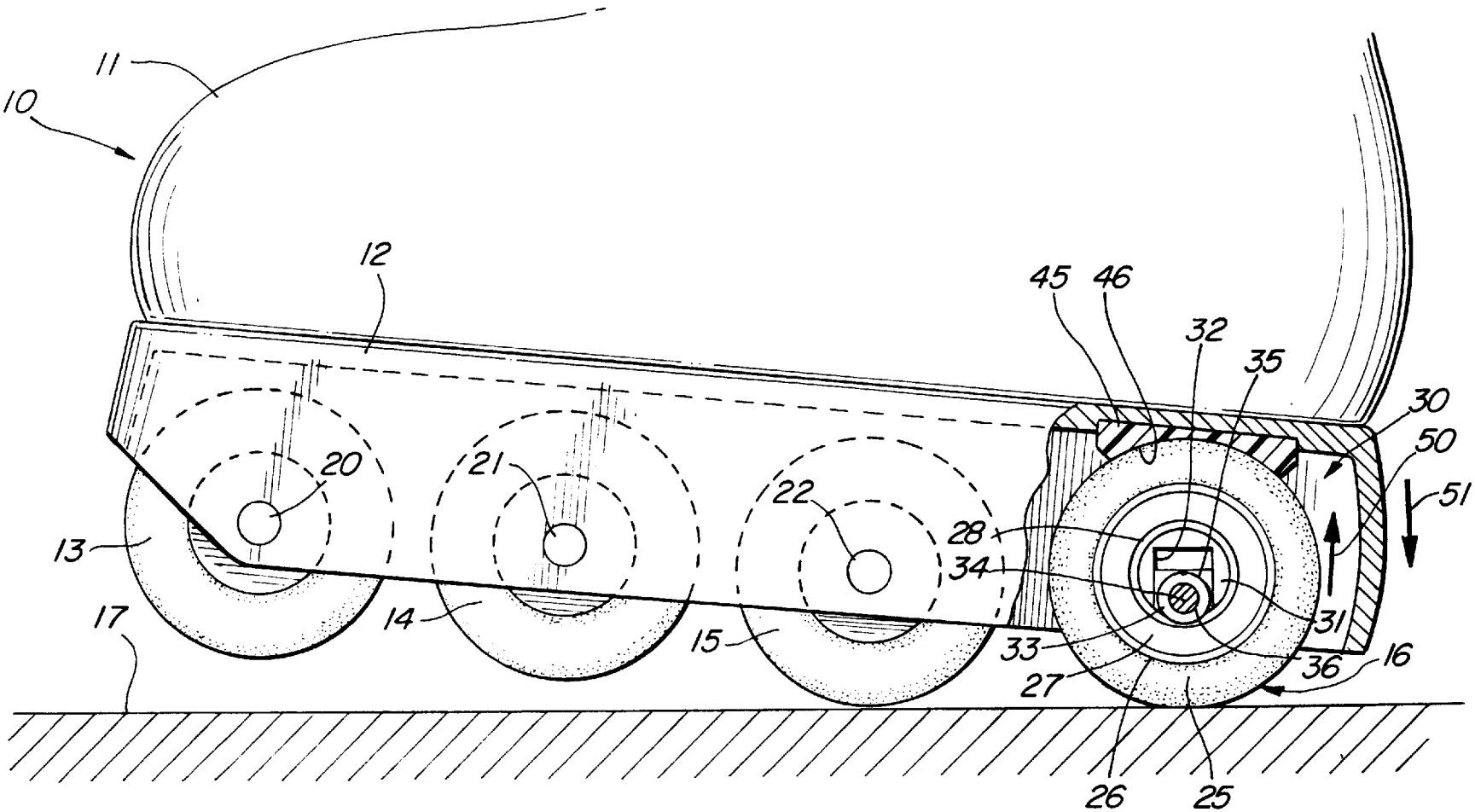
FIG. 1 sets forth a partially sectioned side elevation view of an in-line skate utilizing the present invention braking device.

FIG. 1 sets forth a partially sectioned side elevation view of an in-line skate generally referenced by numeral 10 which supports a brake assembly constructed in accordance with the present invention and generally referenced by numeral 30. In-line skate 10 includes a boot 11 supporting a frame 12 on its underside having conventional fabrication for receiving and securing a human foot. In further accordance with conventional fabrication techniques, frame 12 supports a plurality of rolling wheels 13, 14 and 15 secured to frame 12 by axles 20, 21 and 22 in accordance with conventional fabrication techniques which allow wheels 13 through 15 to be rollable and supported by high speed bearing upon a skating surface 17.

In accordance with the present invention, brake assembly 30 is operative upon a rear wheel 16 which completes the plurality of wheels supported by frame 12. It will be understood that different numbers of in-line wheels may be utilized in providing rolling support for skate 10 without departing from the spirit and scope of the present invention. Brake assembly 30 supports rear wheel 16 within frame 12 in a movable support described below in which the user is able to shift wheel 16 upwardly within frame 12 to force wheel 16 against a braking surface thereby providing a braking action.

More specifically, wheel 16 includes a tire 25 secured to a rim 26. A bearing 27 having an inner race 28 completes the structure of wheel 16. In accordance with the present invention, a channel spacer 31 defining an interior channel 32 is received within inner race 28. In further accordance with the present invention, channel spacer 31 receives a generally rectangular axle block 35 in a sliding engagement of channel 32. Axle block 35 in turn supports a cylindrical axle boss 33 defining an axle bore 36. As is set forth below in greater detail, axle bore 36 receives an axle 47 which secures one side of brake assembly 30 to frame 12. As is better seen in FIG. 2, axle block 35 is vertically supported by a spring 43 (seen in FIG. 2). As is also described below in greater detail, spring 43 operates to bias wheel 16 downwardly with respect to frame 12 and boot 11 in the absence of a sufficient force upon wheel 16.

In further accordance with the present invention, a brake shoe 45 formed of a suitably friction producing material defines a brake surface 46 conforming generally to the outer surface of tire 25. In an alternate fabrication of the present invention, brake shoe 45 may be integrally formed with frame 12 to avoid the use of a separate brake shoe member in place of brake shoe 45. In either event, the essential function of brake shoe 45 is to provide a static brake surface 46 which conforms sufficiently to the outer surface of tire 16 to provide frictional engagement therewith and thereby provide braking force when needed.

Figure 4:
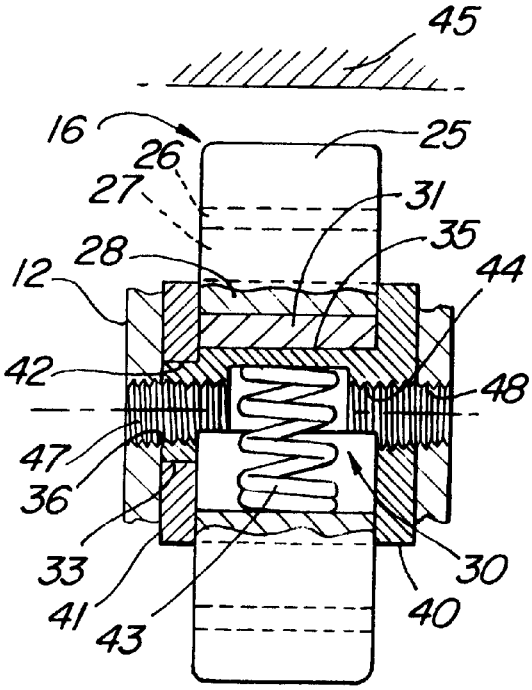
FIG. 4 sets forth a partial section view of the present invention braking device and in-line skate wheel of FIG. 2 showing the braking apparatus in the normal skating configuration.

In operation, as the user employs skate 10 in accordance with normal skating posture, the skater's weight is distributed simultaneously between wheels 13, 14, 15 and 16 upon surface 17. Under such circumstance, the biasing spring within brake assembly 30 provides sufficient spring force to position wheel 16 away from brake surface 46 thereby allowing wheel 16 to rotate freely along with wheels 13 through 15. FIG. 4 described below shows the normally biased skating position of brake assembly 30 and wheel 16. Thus, as the skater rolls along on all four wheels of skate 10, no braking action is provided.

In operation of brake assembly 30 and in accordance with the present invention, the user simply shifts the user's weight upon skate 10 to be largely imposed upon wheel 16 by lifting the frontal portion of skate 10 and raising wheels 13, 14 and possibly 15 out of contact with surface 17. With skate 10 so positioned, the user's weight exerts a force downwardly upon frame 12 which is applied to brake assembly 30 and which is sufficient to overcome the bias force of spring 43 (seen in FIG. 4). As spring 43 is compressed, and in accordance with an important aspect of the present invention, wheel 16, rim 26, bearing 27, inner race 28 and channel spacer 31 are moved upwardly with respect to frame 12 as the compression of spring 43 (seen in FIG. 4) allows a downward relative motion of axle block 35, axle boss 33 and axle 34. The net effect is the upward movement of wheel 16 with respect to frame 12 as indicated by arrow 50 bringing frame 12 downwardly as indicated by arrow 51 and forcing tire 25 upwardly against brake surface 46 of brake shoe 45. The friction between brake surface 46 and the cooperating surface of tire 25 provides a braking action rapidly slowing the skater. Once the braking action is no longer needed, the skater simply pivots forwardly on skate 10 restoring the contact of wheels 13 through 15 with surface 17 and redistributing the skater's weight between all four wheels. With the skater's weight thus redistributed, the force of spring 43 (seen in FIG. 4) again biases wheel 16 away from brake surface 46 into general alignment with wheels 13 through 15. This in turn restores normal skating action.

Figure 2:
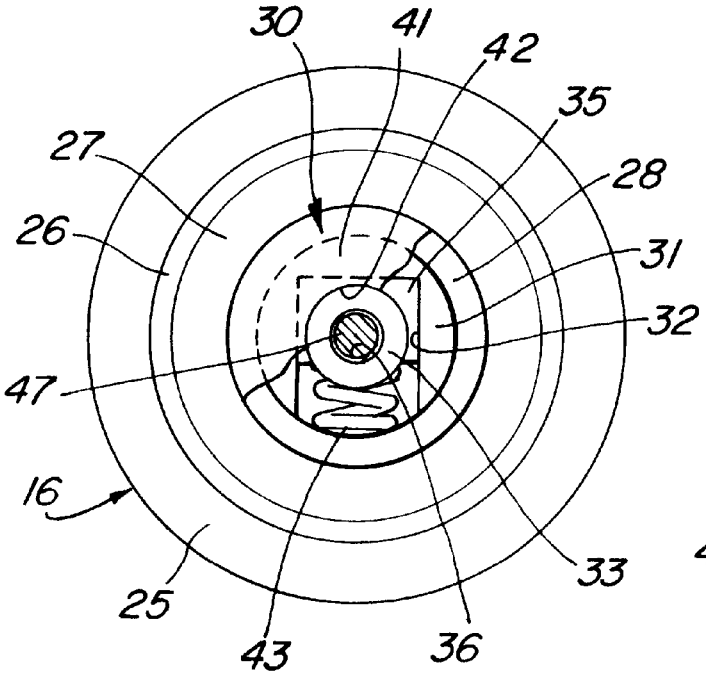
FIG. 2 sets forth a partial section view of the present invention braking device supported within a cooperating in-line skate wheel.

FIG. 2 sets forth a partially sectioned side elevation view of the present invention brake assembly within wheel 16. In the configuration shown in FIG. 2, brake assembly 30 supports wheel 16 in the normal or freely rolling nonbreaking position. Thus, as described above, wheel 16 includes a tire 25 coupled to a rim 26 which in turn receives a bearing 27. Bearing 27 includes an inner race 28 and completes the structure of wheel 16. In further accordance with the present invention, brake assembly 30 includes a channel spacer 31 received within the interior of inner race 28 and defining a channel 32. An axle block 35, which as is better seen in FIG. 6 is supported by hub 40, also seen in FIG. 6, is slidably received within channel 32 and further supports an axle boss 33. Axle boss 33 is received within an aperture 42 formed in hub 41 and in turn defines a threaded axle bore 36 which receives axle 47. As described above, axle block 35 is slidably supported within channel 32 of channel spacer 31 and is biased toward the upper end of channel 32 by a spring 43. Under normal circumstances, spring 43 provides sufficient upwardly exerted biasing force to maintain the normal concentric alignment between axle 47 and wheel 16. Thus, the configuration of brake assembly 30 shown in FIG. 2 corresponds to the configuration shown in FIG. 4. When the skater undertakes the above-described tilting or pivoting of skate 10 (seen in FIG. 1) to increase the proportion of the skater's weight applied to wheel 16, the force of spring 43 is overcome allowing a relative movement of wheel 16 upwardly with respect to axle 47 thereby producing the braking position of brake assembly 30 shown in FIGS. 1 and 5.

Figure 3:
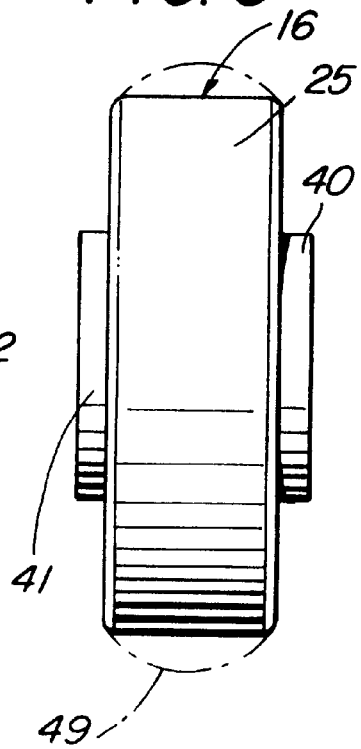
FIG. 3 sets forth a rear view of the braking device and in-line skate wheel of FIG. 2.

FIG. 3 sets forth a rear view of wheel 16 having tire 25 showing wheel 16 supported between hubs 40 and 41. It will be understood by those skilled in the art that the shape of tire 25 of wheel 16 is largely a matter of design choice. The shape of tire 25 shown for purposes of illustration is not intended in any way to limit the present invention braking device to any particular tire shape. In accordance with general fabrication techniques, the shape of tires used for in-line skates varies as practitioners design wheels and tires to meet different operating conditions. The most typical in-line skate tire utilizes a crowned surface such as crowned surface 49 shown in dashed-line representation in FIG. 3. However, virtually any shaped wheel and tire combination may be used in combination with the present invention braking device.

FIG. 4 sets forth a partially sectioned view of wheel 16 supporting brake assembly 30 in the normal cruising or freely rotating position which the brake assembly assumes in the absence of the above-described braking action by the skater. As set forth above, wheel 16 includes a tire 25 coupled to a rim 26 which in turn is rotatably supported by a bearing 27. Bearing 27 includes an inner race 28 which supports a channel spacer 31. A channel 32 is formed within spacer 31 and receives an axle block 35 in a sliding engagement. Axle block 35 is supported by and preferably integrally formed with a hub 40. Axle block 35 further supports an axle boss 33 extending therefrom which in turn defines an axle bore 36. A hub 41 defines an annular member having an aperture 42 formed therein which receives axle boss 33. Axle block 35 further defines a recess 44 on the underside thereof within which a coil spring 43 is captivated and extends downwardly against inner race 28 of bearing 27. A frame 12, which as is better seen in FIG. 1 is secured to the underside of boot 11 of skate 10, extends on each side of brake assembly 30 and is secured to hubs 40 and 41 by a pair of axles 48 and 47. In the embodiment shown in FIG. 4, axles 47 and 48 threadably engage hubs 41 and 40 respectively to secure hubs 40 and 41 to frame 12. However, it will be apparent to those skilled in the art that different types of axle attachment may be utilized to secure hubs 40 and 41 to frame 12 without departing from the spirit and scope of the present invention.

In accordance with an important aspect of the present invention, channel spacer 31 is fitted within the interior surface of inner race 28 of bearing 27 such that channel 32 formed therein is downwardly open in the position shown. In further accordance with the present invention, the width of axle block 35 is slightly greater than the width of channel spacer 31 thereby supporting hubs 40 and 41 close to but slightly spaced from channel spacer 31. This allows the combined assembly of hub 40, axle block 35, axle boss 33, and hub 41 to be slidably movable with respect to channel spacer 31 and the remainder of wheel 16. As a result, the secure attachment of hubs 40 and 41 to frame 12 provided by axles 48 and 47 respectively permits wheel 16 and channel spacer 31 to move vertically as axle block 35 slides within channel 32 of channel spacer 31. The degree of motion provided by this sliding support is illustrated in FIGS. 4 and 5 and ranges between the normal concentric free-wheeling arrangement shown in FIG. 4 to the offset braking position shown in FIG. 5.

The captivation of spring 43 between the bottom interior surface of inner race 28 and recess 44 biases wheel 16 downwardly with respect to frame 12 until axle block 35 abuts the end surface of channel 32 within channel spacer 31. In the preferred fabrication of the present invention, the spring force of spring 43 is selected to be greater than the proportionate part of the skater's weight applied to wheel 16 when all skate wheels are on the ground and to be less than the force produced when the skater's weight is all or largely imposed upon wheel 16 during the tilted position of the skate illustrated in FIG. 1. Thus, under normal skating conditions with weight equally distributed among the skate wheels, spring 43 biases wheel 16 downwardly with respect to frame 12 creating a space between brake shoe 45 and the outer surface of tire 25. With increased force as described above, spring 43 collapses reconfiguring brake assembly 30 to the braking position shown in FIG. 5.

Figure 5:
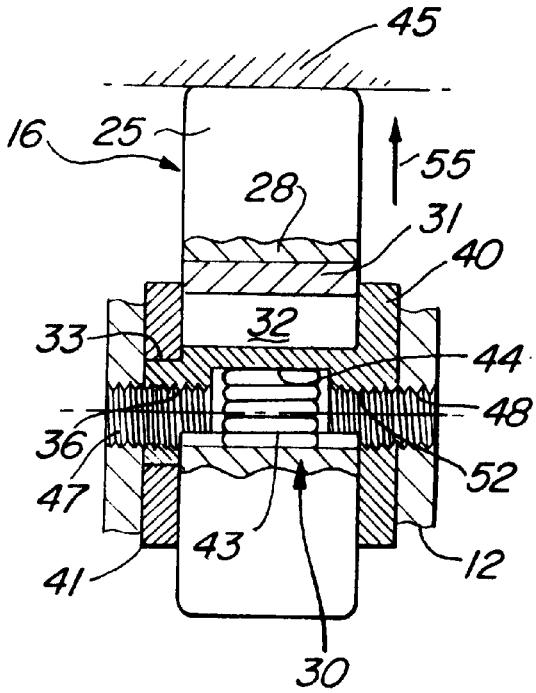
FIG. 5 sets forth a section view of the present invention braking device and in-line skate wheel of FIG. 2 showing the braking device during braking action.
Figure 6:
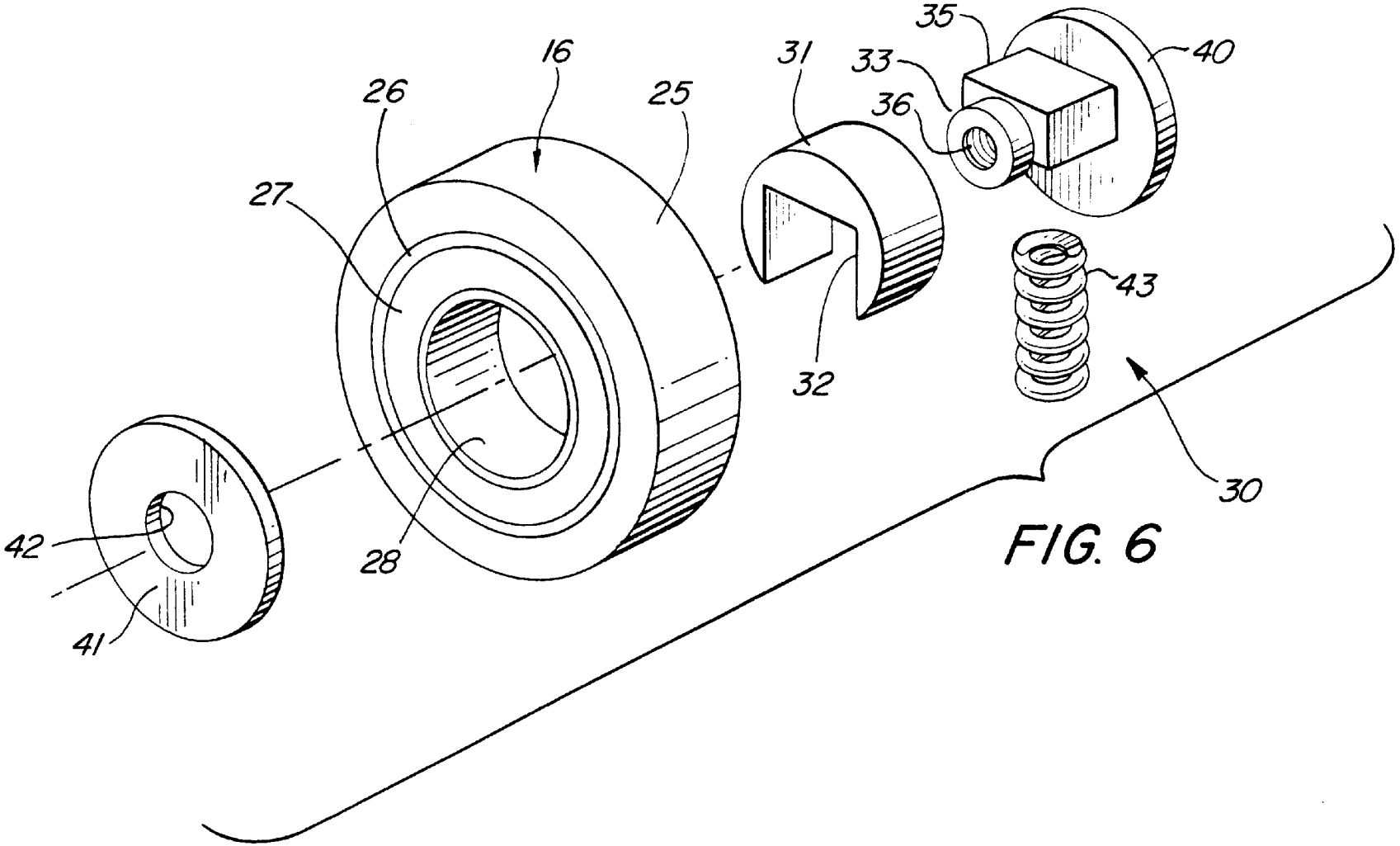
FIG. 6 sets forth a perspective assembly view of the present invention braking device assembleable within a cooperating in-line skate wheel.

FIG. 5 sets forth a partial section view of the present invention brake assembly operative within wheel 16 during the application of braking action illustrated in FIG. 1. As described above, wheel 16 includes a tire 25 coupled to a rim 26 which in turn is rotatably supported by a bearing 27. Bearing 27 includes an inner race 28 which supports a channel spacer 31. A channel 32 is formed within spacer 31 and receives an axle block 35 in a sliding engagement. Axle block 35 is supported by and preferably integrally formed with a hub 40. Axle block 35 further supports an axle boss 33 extending therefrom which in turn defines an axle bore 36. A hub 41 defines an annular member having an aperture 42 formed therein which receives axle boss 33. Axle block 35 further defines a recess 44 on the underside thereof within which a coil spring 43 is captivated and extends downwardly against inner race 28 of bearing 27. A frame 12, which as is better seen in FIG. 1 is secured to the underside of boot 11 of skate 10, extends on each side of brake assembly 30 and is secured to hubs 40 and 41 by a pair of axles 48 and 47. In the embodiment shown in FIG. 4, axles 47 and 48 threadably engage hubs 41 and 40 respectively to secure hubs 40 and 41 to frame 12. However, it will be apparent to those skilled in the art that different types of axle attachment may be utilized to secure hubs 40 and 41 to frame 12 without departing from the spirit and scope of the present invention.

FIG. 5 shows the braking action of brake assembly 30 as the skater employs the tilting of skate 10 illustrated in FIG. 1 to apply sufficient force to brake assembly 30 to collapse spring 43. As mentioned above, the sliding engagement of axle block 35 within channel 32 of channel spacer 31 allows the combined structure of hub 40, axle block 35, axle boss 33 and hub 41 to remain secured to frame 12 while the combination of channel spacer 31 and wheel 16 is movable with respect to frame 12. In the position shown in FIG. 5, sufficient weight has been applied to overcome the bias force of spring 43 and collapse spring 43 allowing channel spacer 31 and wheel 16 to move upwardly with respect to frame 12 in the direction indicated by arrow 55. This upward movement forces the outer surface of tire 16 against brake shoe 45 to produce frictional drag and braking action which slows the skater. When the braking force is no longer desired, the user again reorients the skate to bring all wheels in contact with the skating surface and allows the force of spring 43 to drive wheel 16 and channel spacer 31 downwardly to the free-rolling position shown in FIG. 4. Thus, an effective and efficient braking system is provided which avoids the need to articulate pivotal arm supports and the like which prior art systems have heretofore required. The entire braking assembly is received within a specially cooperating wheel to provide an integral wheel support and brake assembly which does not interfere or specially modify the skate frame or skating characteristics.

FIG. 6 sets forth a perspective assembly view of the present invention brake assembly generally referenced by numeral 30 and a cooperation wheel generally referenced by numeral 16. Wheel 16 includes a tire 25 coupled to a rim 26 which in turn is coupled to a bearing 27. Bearing 27 includes an inner race 28 which in accordance with conventional bearing fabrication allows race 28 to be freely rotatable with respect to the remainder of bearing 27, rim 26 and tire 25. In accordance with the preferred fabrication of the present invention, the diameter of inner race 28 is sized to receive a channel spacer 31 having a largely cylindrical outer surface in a secure precision fit. Channel spacer 31 defines a channel 32 and is received within inner race 28 in the above-described tight precision fit. Thus, for all practical purposes, channel spacer 31 becomes joined to inner race 28. This in turn allows the combined structure of tire 25 and rim 26 to rotate with respect to inner race 28 through the action of bearing 27. Brake assembly 30 further includes a hub 40 having an axle block 45 joined thereto which in turn supports a cylindrical axle boss 33. In the preferred fabrication of the present invention, hub 40, axle block 35 and axle boss 33 are integrally formed as a single common member. As is better seen in FIG. 4, axle block 35 defines a recess 44 on the undersurface thereof. Recess 44 receives the upper end of a coil spring 43. The bottom end of spring 43 is forced against the inner race 28 and captivated between axle block 35 and inner race 28 following the assembly of channel spacer 31 into inner race 28 and the insertion of axle block 35 into channel 32. With axle block 35 thus assembled, axle boss 33 extends beyond channel spacer 31. Hub 41 defines an aperture 42 sized to fit upon axle boss 33 and thereby allow assembly of hub 41.

With the assembly of channel spacer 31 into inner race 28 and the assembly of hub 40 and axle block 35 to spacer 31 captivating spring 43 as described, the assembly of hub 41 upon axle boss 33 completes the combined assembly of wheel 16 and brake assembly 30. At this point, the combined assembly is secured to the in-line skate frame using for example threaded axles as shown in FIGS. 4 and 5.

What has been shown is an integral wheel support and brake for in-line skate which is extremely simple and low cost and which is nonetheless safe and reliable in use. The entire brake assembly utilizes a cooperating wheel to provide a highly reliable and highly effective brake mechanism which is low in cost and which requires no alteration of the in-line skate frame.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with an in-line skate having a skate frame, an integral wheel support and brake comprising:

a plurality of load-bearing wheels including a front wheel a rear wheel and one or more intermediate wheels, said wheels being supported by the skate frame to align the outer surfaces thereof in a straight-line relationships;

a wheel bearing within said rear wheel;

a channel spacer coupled to said wheel bearing defining a vertical channel;

a wheel support constructed to be attached to the skate frame and slidably received within said vertical channel;

spring means applying a bias force to urge said rear wheel downwardly with respect to said wheel support; and a brake surface above said rear wheel, said spring means applying a bias force to maintain said rear wheel away from said brake surface allowing said rear wheel to support its proportionate part of the skater's weight when all of said wheels are bearing a skater's weight and insufficient to maintain said rear wheel away from said brake surface when the skater shifts weight disproportionately upon said rear wheel.

2. The integral wheel support and brake set forth in claim 1 wherein said wheel bearing includes an inner race and wherein said channel spacer is coupled to said inner race.

3. The integral wheel support and brake set forth in claim 2 wherein said vertical channel defines side surfaces and a closed upper end and wherein said spring means urge said wheel support against said closed upper end of said vertical channel.

4. The integral wheel support and brake set forth in claim 3 wherein said wheel support includes first and second hubs and an axle block extending therebetween and wherein said axle block is receive within said vertical channel.

5. The integral wheel support and brake set forth in claim 4 wherein said spring means includes a coil spring captivated between said axle block and said inner race.

6. The integral wheel support and brake set forth in claim 5 wherein said inner race defines a generally cylindrical interior surface and wherein said channel spacer defines a generally cylindrical outer surface received within said interior surface.

7. The integral wheel support and brake set forth in claim 2 wherein said inner race defines a generally cylindrical interior surface and wherein said channel spacer defines a generally cylindrical outer surface received within said interior surface.

8. The integral wheel support and brake set forth in claim 7 wherein said vertical channel defines side surfaces and a closed upper end and wherein said spring means urge said wheel support against said closed upper end of said vertical channel.

9. The integral wheel support and brake set forth in claim 8 wherein said wheel support includes first and second hubs and an axle block extending therebetween and wherein said axle block is receive within said vertical channel.

10. The integral wheel support and brake set forth in claim 9 wherein said spring means includes a coil spring captivated between said axle block and said inner race.

11. For use in combination with an in-line skate having a skate frame, an integral wheel support and brake comprising:

a plurality of wheels supported by said skate frame in an in-line generally equal proportionate load-bearing arrangement, said plurality of wheels including front wheel, a rear wheel and one or more intermediate wheels;

a brake shoe having a brake surface;

a rear wheel bearing for rolling said rear wheel;

a sliding support, coupled to said rear wheel bearing, supporting said rear wheel upon the skate frame such that said rear wheel is movable between a first position against said brake surface and a second position spaced from said brake surface in said in-line generally proportionate load-bearing arrangement; and spring means coupled between said sliding support and said wheel bearing having sufficient spring force for maintaining said sliding support at said second position when the skater's weight is generally equally imposed upon said wheels.

* * * * *